US005944242A

United States Patent [19]

Musarella et al.

[11] Patent Number: 5,944,242

[45] Date of Patent: Aug. 31, 1999

[54] TOOL HOLDER

[76] Inventors: Michael Musarella; Steven Hnatowicz, both of 36 Woehrie Ave., Staten Island, N.Y. 10312

[21] Appl. No.: 08/649,057

[22] Filed: May 16, 1996

[51] Int. Cl.[6] ..... A45F 5/00

[52] U.S. Cl. ..... 224/667; 224/270; 224/904; D3/228

[58] Field of Search ..... 224/904, 269, 224/666, 667, 248, 270, 669, 678; D3/228, 219, 215

[56] References Cited

U.S. PATENT DOCUMENTS

| | | | |
|---|---|---|---|
| D. 240,370 | 7/1976 | Kuehl | D3/228 |
| D. 258,550 | 3/1981 | Strauss | D3/228 |
| D. 273,821 | 5/1984 | Bianchi | D3/215 |
| D. 345,052 | 3/1994 | Stokke et al. | D3/228 |
| D. 374,604 | 10/1996 | Hnatowicz et al. | D3/228 X |
| 1,326,887 | 12/1919 | Wood | 224/904 |
| 3,200,536 | 8/1965 | Petitto, Sr. | 224/269 X |
| 3,777,953 | 12/1973 | Lewis | 224/666 X |
| 4,358,036 | 11/1982 | Maltais | 224/667 |
| 4,372,468 | 2/1983 | Harvey | 224/904 |
| 4,830,244 | 5/1989 | Brannon | 224/269 X |
| 4,936,499 | 6/1990 | Gulley | 224/904 |
| 5,176,302 | 1/1993 | Smith | 224/904 |
| 5,210,532 | 5/1993 | Knoedler et al. | 224/269 X |
| 5,499,429 | 3/1996 | Higginbotham | 224/326 X |
| 5,511,705 | 4/1996 | Dreszer | 224/904 |

*Primary Examiner*—Renee S. Luebke
*Attorney, Agent, or Firm*—Pennie & Edmonds LLP

[57] ABSTRACT

A tool holder for mounting on a user'belt comprising a support member having two front supports and two rear supports, each rear support having a rear top portion, a rear bottom portion, and a rear transition portion positioned therebetween. Each front support is spaced from and biased substantially parallel to the rear top portion and being nonparallel to the rear bottom portion. Each rear transition portion extends toward the front support to provide a narrow gap which is smaller than the spacing between the front support and rear top portion, with the rear supports being connected by a support cross member, and the rear bottom portions extending away from the front supports. Also, the rear bottom portions are of substantially the same length as the rear top portions. A bracket member is operatively associated with the front supports for holding a tool. Thus, when the tool holder is mounted on a user'belt, the front supports and rear transitions portions resistance to removal of the support member from the belt.

13 Claims, 8 Drawing Sheets

TOOL HOLDER

BACKGROUND OF THE INVENTION

1. Field of the Invention

The present invention relates to an improved tool holder having a bracket extension to prevent inadvertent removal during use. More particularly, the present invention relates to improved tool holder readily attachable to a belt, pocket or pant/short waist band.

2. Description of the Prior Art

Numerous innovations for tool holding devices have been provided in the prior art that are described as follows. Even though these innovations may be suitable for the specific individual purposes to which they address, they differ from the present invention as hereinafter contrasted.

In U.S. Pat. No. 4,936,499, titled TOOL CARRIER, by inventor, Gulley, a tool carrier having a frame formed from a closed wire loop which includes a tool insertion portion having spaced side rail members connected by an arcuate end bar. In U.S. Pat. No. 5,176,302, titled, BELT MOUNTED CAN HOLDER, by inventor Smith, a holder for a handle of a container comprises a substantially rigid, continuous wire-like member bent to form a belt receiving portion and an integral

SUMMARY OF THE INVENTION

The invention relates to a tool holder for mounting on a user'belt comprising a support member having two front supports and two rear supports, each rear support having a rear top portion, a rear bottom portion, and a rear transition portion positioned therebetween. Each front support is spaced from and biased substantially parallel to the rear top portion and being nonparallel to the rear bottom portion. Each rear transition portion extends toward the front support to provide a narrow gap which is smaller than the spacing between the front support and rear top portion, with the rear supports being connected by a support cross member, and the rear bottom portions extending away from the front supports. Also, the rear bottom portions are of substantially the same length as the rear top portions. A bracket member is operatively associated with the front supports for holding a tool. Thus, when the tool holder is mounted on a user'belt, the front supports and rear transitions portions resistance to removal of the support member from the belt.

In this tool holder, the bracket member can include a pair of side members, with each side member forming a lower end of a front support, and a center member connecting the side members of the bracket member, with the center member having an arcuate shape which projects above the side members. Each transition portion is positioned substantially adjacent to the lower end of the respective front support.

In another embodiment, the bracket member includes a plurality of opposing gate members pivotably mounted thereon. When a bracket cross member is connected between the front supports, the bracket member can include the gate members pivotably mounted thereon. Advantageously, each gate member is pivotably mounted about a pivot pin and biased in opposing position by a spring. Each gate member can be mounted on a side member which forms a lower end of a front support, and each side member can be joined to form a U-shaped portion that is pivotably connected to the bracket cross member. Each gate member can be mounted substantially perpendicular to the rear supports.

In another embodiment, the bracket member can be pivotably connected to the bracket cross member. One particularly desirable arrangement for the bracket member is as a wire bent to form a substantially rectangular shape, with the pivotable connection comprising a cover plate connected to the bracket cross member by a pivot pin. Also, the bent wire can be mounted substantially perpendicular to the rear supports.

DESCRIPTION OF THE PREFERRED EMBODIMENTS

Figure 1:
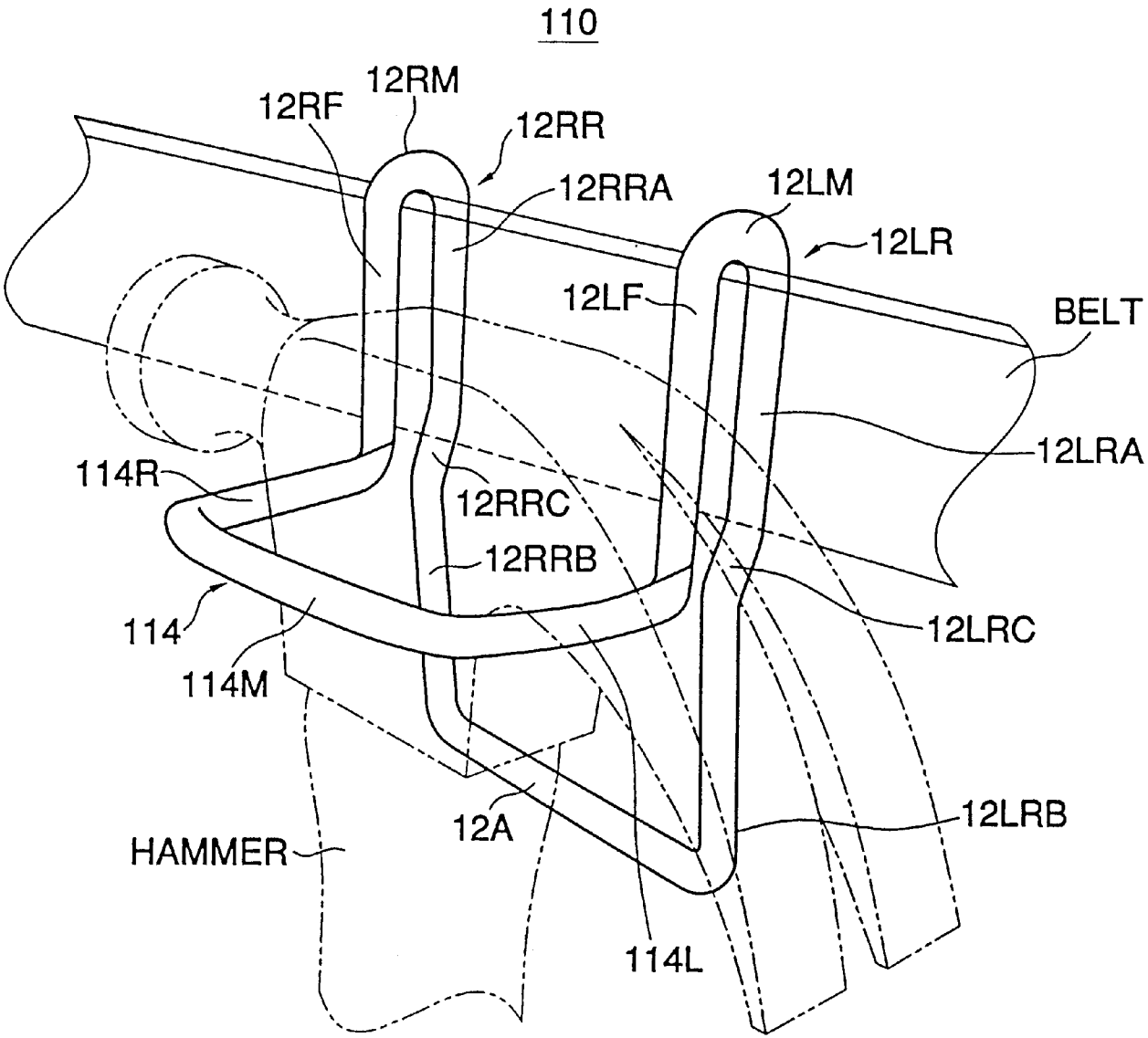
FIGS. 1–3 are perspective, front and side views of a first tool holder of the invention.
Figure 2:
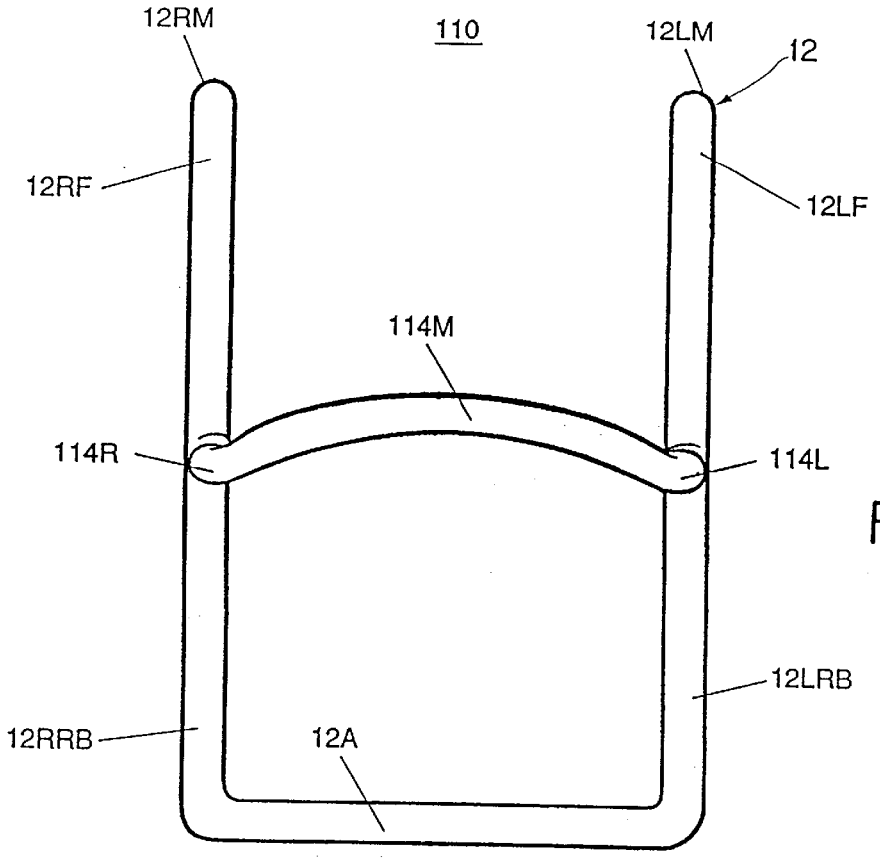
Figure 3:
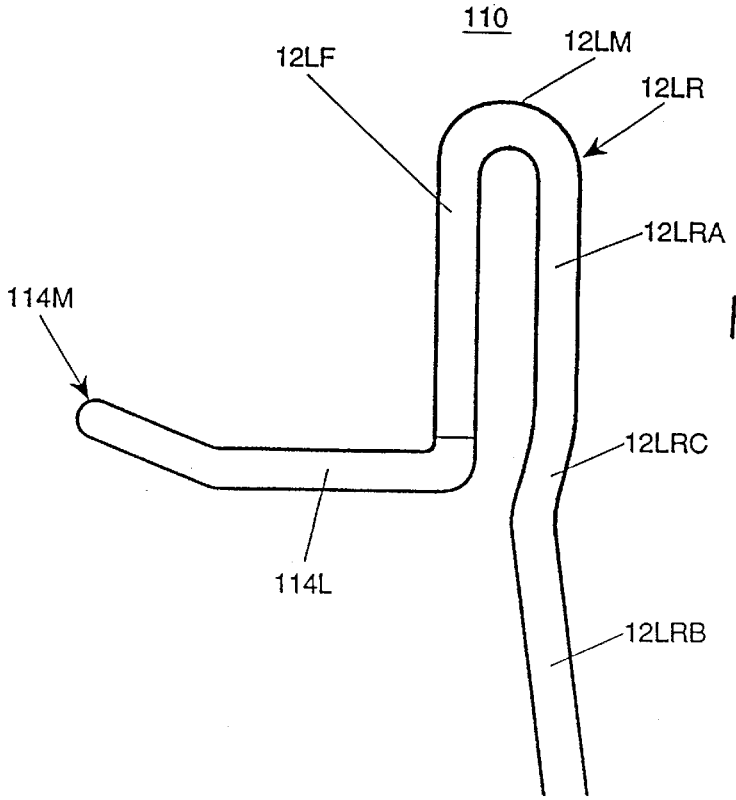

Firstly, referring to FIGS. 1 to 3 which are a left perspective view, front view, left side view, rear view, top view, and bottom view, respectively, of a first tool holder (110). The first tool holder (110) comprises a support which comprises: a right rear support (12RR) having a right front support (12RF) securely connected to a right rear top support (12RRA) by a right middle support (12RF). The right rear top support (12RRA) is securely fastened to a right rear bottom support (12RRB) by a right rear transition support (12RRC). The right rear transiton support (12RRC) is at an inward obtuse angle to the right rear top support (12RRA) and the right rear bottom support (12RRB). The right front support (12RF) is parallel to the right rear top support (12RRA) and the right rear bottom support (12RRB).

A left rear support (12LR) which comprises a left front support (12LF) securely connected to a left rear top support (12LRA) by a left middle support (12LF). The left rear top support (12LRA) is securely fastened to a left rear bottom support (12LRB) by a left rear transition support (12LRC). The left rear transition support (12LRC) is at an inward obtuse angle to the left rear top support (12LRA) and the left rear bottom support (12LRB). The right rear transition support (12RRC) and the left rear transition support (12LRC) function to prevent inadvertent removal of the tool holder when a user withdraws a tool. The left front support (12LF) is parallel to the left rear top support (12LRA) and the left rear bottom support (12LRB).

A support cross member (12A) is securely fastened at a lower distal end of the right rear bottom support (12RRB) and at a lower distal end of the left rear bottom support (12LRB). The left rear bottom support (12LRB) and the right rear bottom support (12RRB) function as a lever to prevent inadvertent removal of the tool holder from the user when a tool is withdrawn. The support cross member (12A) functions to connect the right rear support (12RR) to the left rear support (12LR). The first tool holder (110) is securely attached at a lower distal end of the right front support (12RF) and the left front support (12LF). The first tool holder (110) comprises a first tool holder bracket (114) consisting of first tool holder bracket right member (114R) securely connected to a first tool holder bracket left member (114L) by a first tool holder bracket middle member (114M).

The first tool holder (110) is manufactured from a material selected from a group consisting of metal, metal alloy, plastic, plastic composite, rubber, rubber composite, fiberglass, epoxy, and carbon-graphite.

Figure 4:
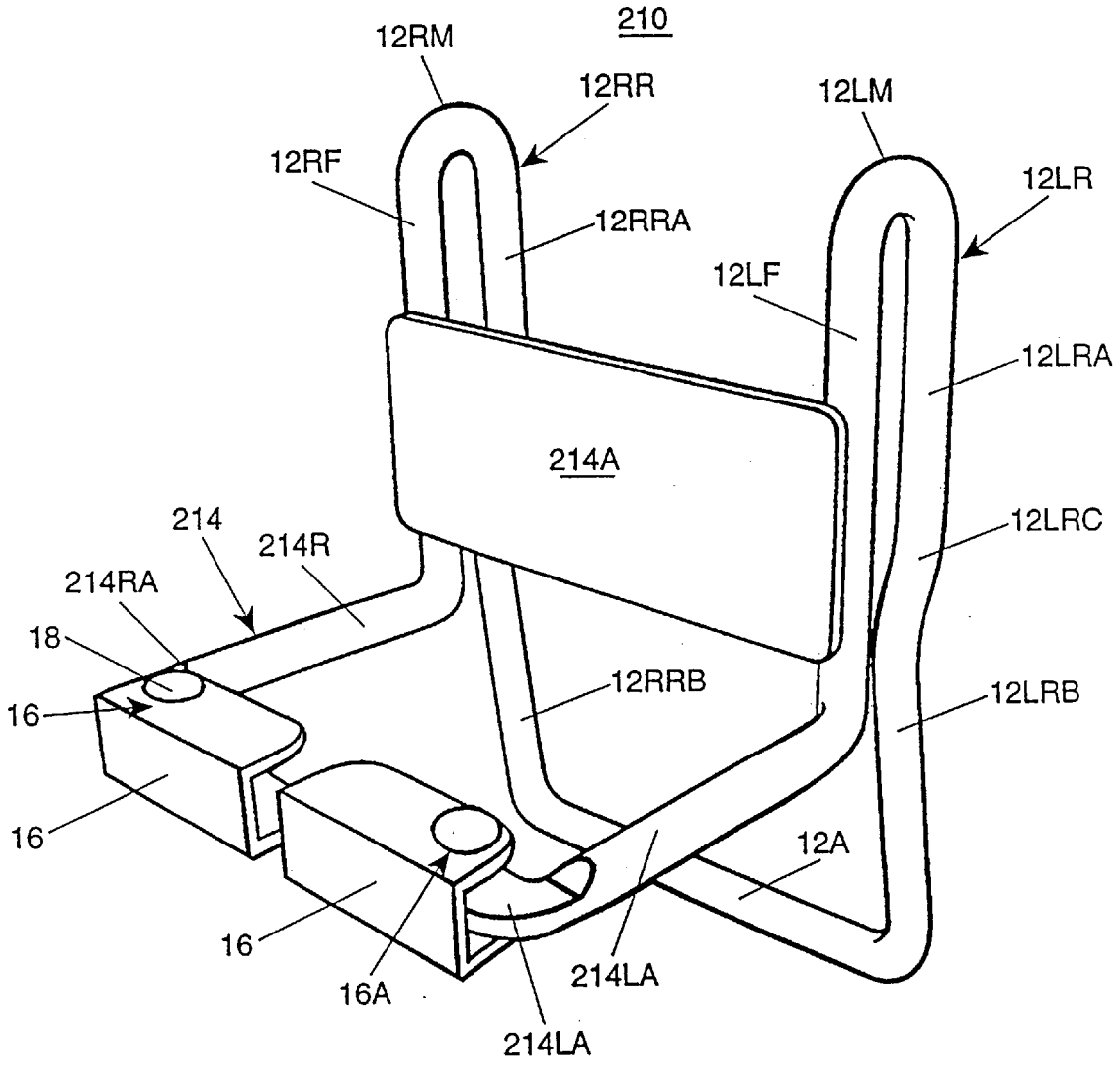
FIGS. 4–6 are perspective, front and side views of a second tool holder of the invention.
Figure 5:
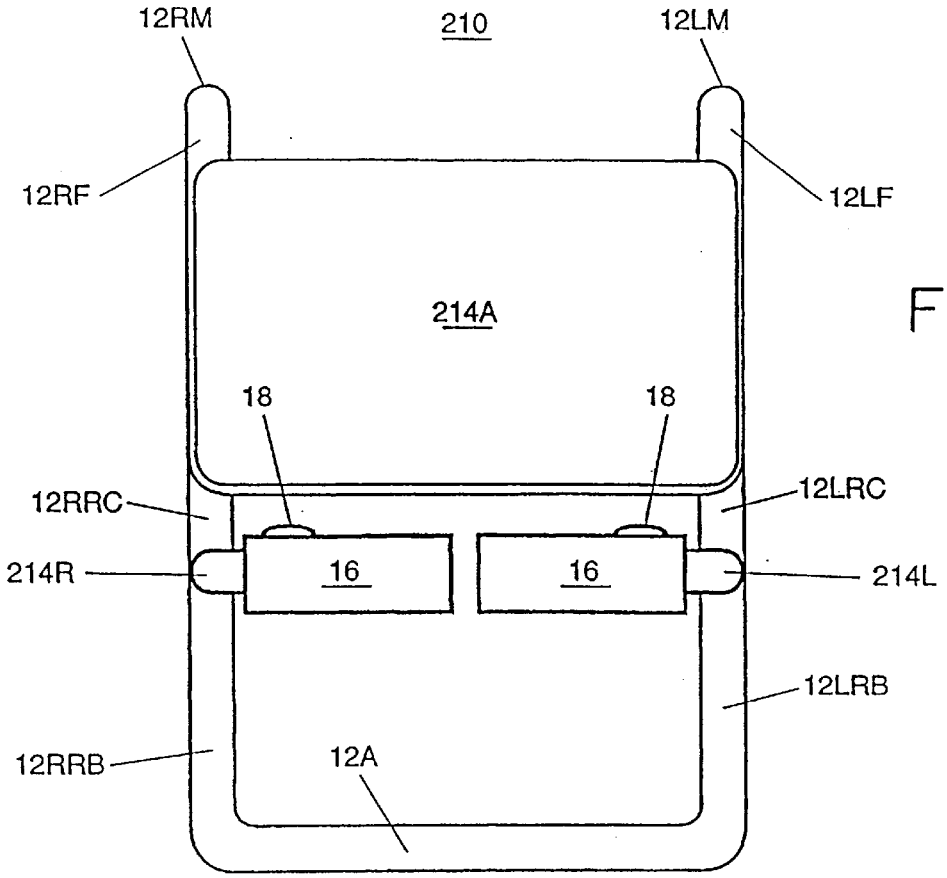
Figure 6:
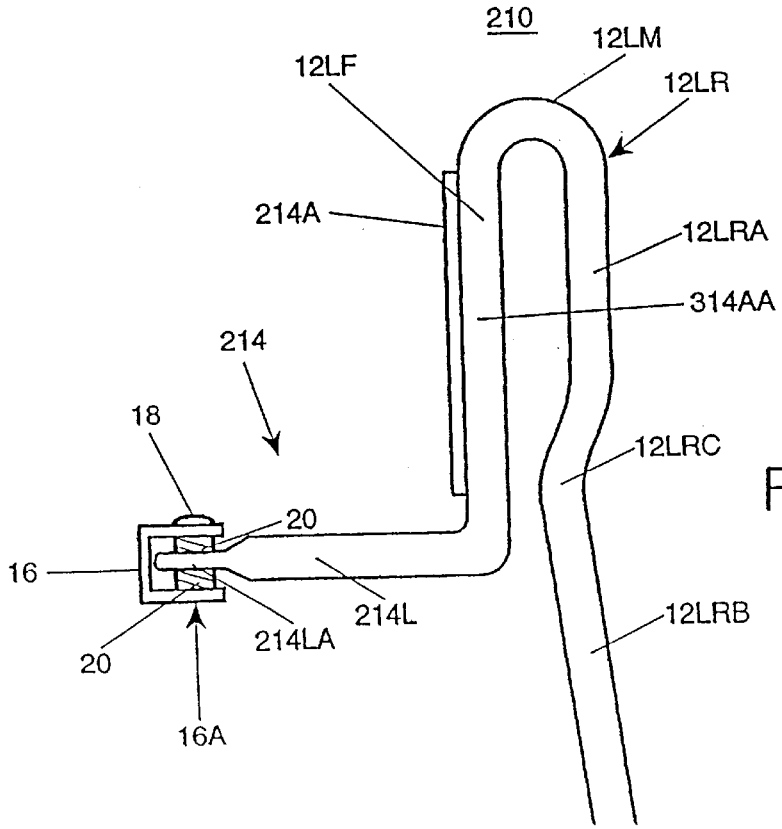

Referring to FIGS. 4 to 6 which are a left perspective view, front view, left side view, rear view, top view, and bottom view, respectively, of a second tool holder (210). The second tool holder (210) comprises a support (12) which comprises: a right rear support (12RR) having a right front support (12RF) securely connected to a right rear top support (12RRA) by a right middle support (12RF). The right rear top support (12RRA) is securely fastened to a right rear bottom support (12RRB) by a right rear transition support (12RRC). The right rear transition support (12RRC) is at an inward obtuse angle to the right rear top support (12RRA) and the right rear bottom support (12RRB). The right front support (12RF) is parallel to the right rear top support (12RRA) and the right rear bottom support (12RRB).

A left rear support (12LR) which comprises a left front support (12LF) securely connected to a left rear top support (12LRA) by a left middle support (12LF). The left rear top support (12LRA) is securely fastened to a left rear bottom support (12LRB) by a left rear transition support (12LRC). The left rear transition support (12LRC) is at an inward obtuse angle to the left rear top support (12LRA) and the left rear bottom support (12LRB). The right rear transition support (12RRC) and the left rear transition support (12LRC) function to prevent inadvertent removal of the tool holder when a user withdraws a tool. The left front support (12LF) is parallel to the left rear top support (12LRA) and the left rear bottom support (12LRB).

A support cross member (12A) is securely fastened at a lower distal end of the right rear bottom support (12RRB) and at a lower distal end of the left rear bottom support (12LRB). The left rear bottom support (12LRB) and the right rear bottom support (12RRB) function as a lever to prevent inadvertent removal of the tool holder from the user when a tool is withdrawn. The support cross member (12A) functions to connect the right rear support (12RR) to the left rear support (12LR). The second tool holder (210) is securely attached at a lower distal end of the right front support (12RF) and the left front support (12LF).

The second tool holder bracket (214) comprises a second tool holder bracket cross member (214A) securely fastened to the right front support (12RF) and the left front support (12LF). The second tool holder bracket (214) further comprises a second tool holder bracket right member (214R) having a second tool holder bracket right front member (214RA) which is pivotally mounted by a pivot pin (18) to a U-channel bracket (16) having a U-channel bracket pin opening (16A) therein through which the pivot spring (18) is inserted. A spring (20) is mounted around the pivot pin (18). The spring functions to return the U-channel bracket (16) to a perpendicular position to the second tool holder bracket right member (214R). The second tool holder bracket (214) further comprises a second tool holder bracket left member (214L) having a second tool holder bracket left front member (214LA) which is pivotally mounted by a pivot pin (18) to a U-channel bracket (16) having a U-channel bracket pin opening (16A) therein through which the pivot pin (18) is inserted. A spring (20) is mounted around the pivot pin (18). The spring functions to return the U-channel bracket (16) to a perpendicular position to the second tool holder bracket left member (214L).

The second tool holder (210) is manufactured from a material selected from a group consisting of metal, metal alloy, plastic, plastic composite, rubber, rubber composite, fiberglass, epoxy, and carbon-graphite.

Figure 7:
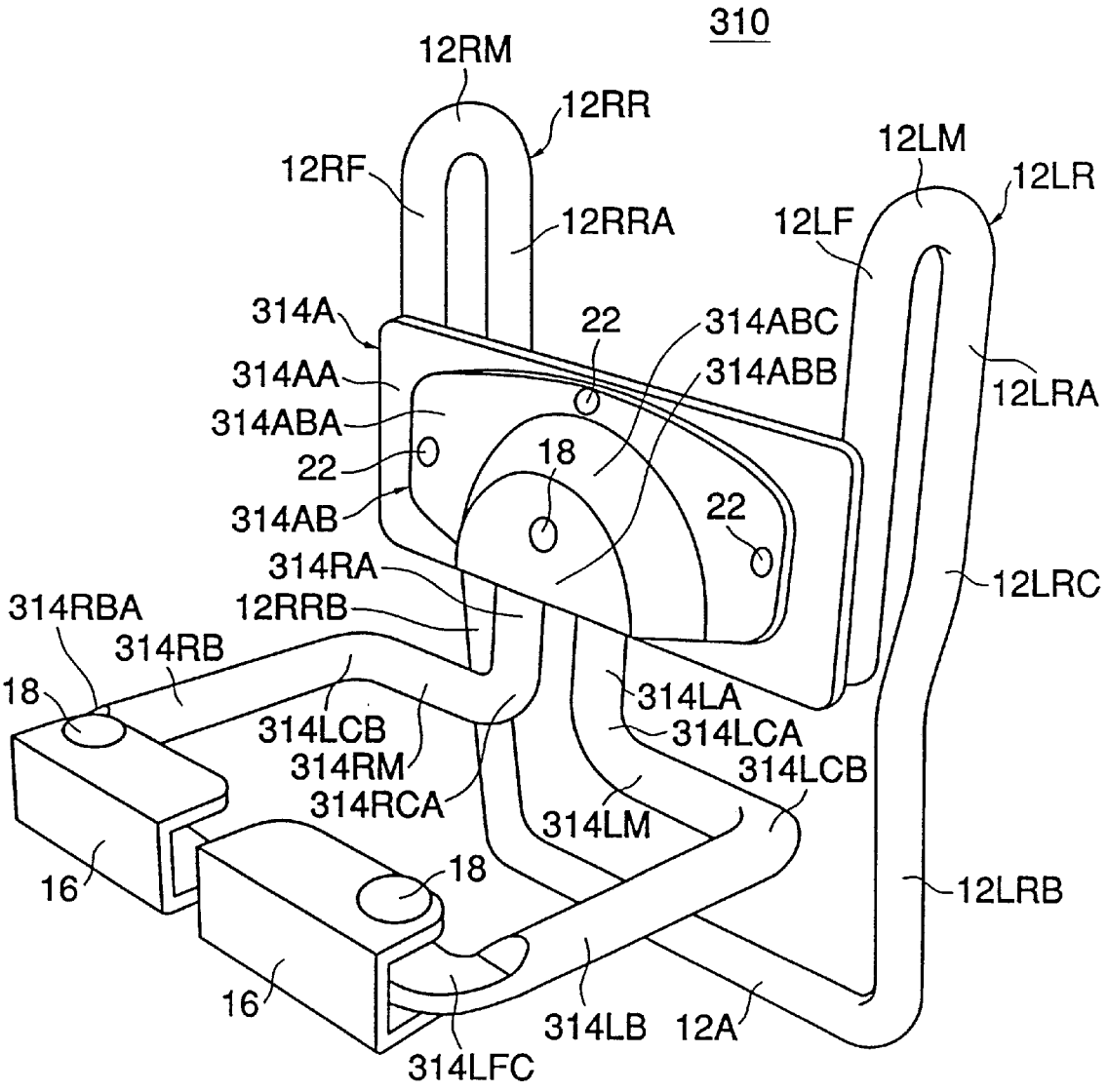
FIGS. 7–9 are perspective, front and side views of a third tool holder of the invention.
Figure 8:
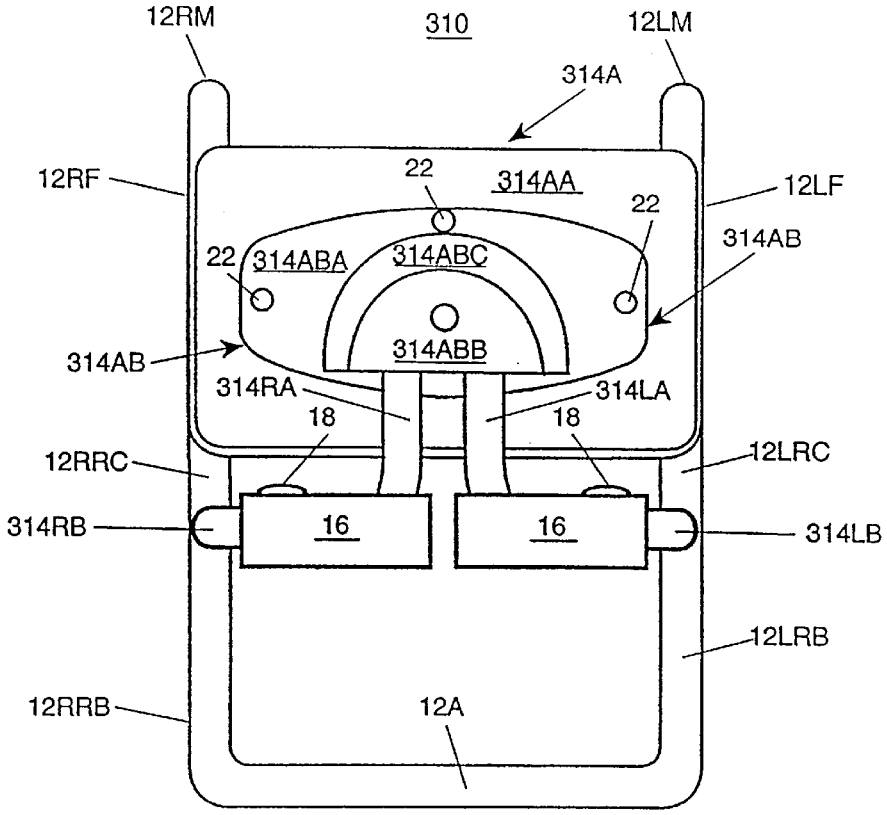
Figure 9:
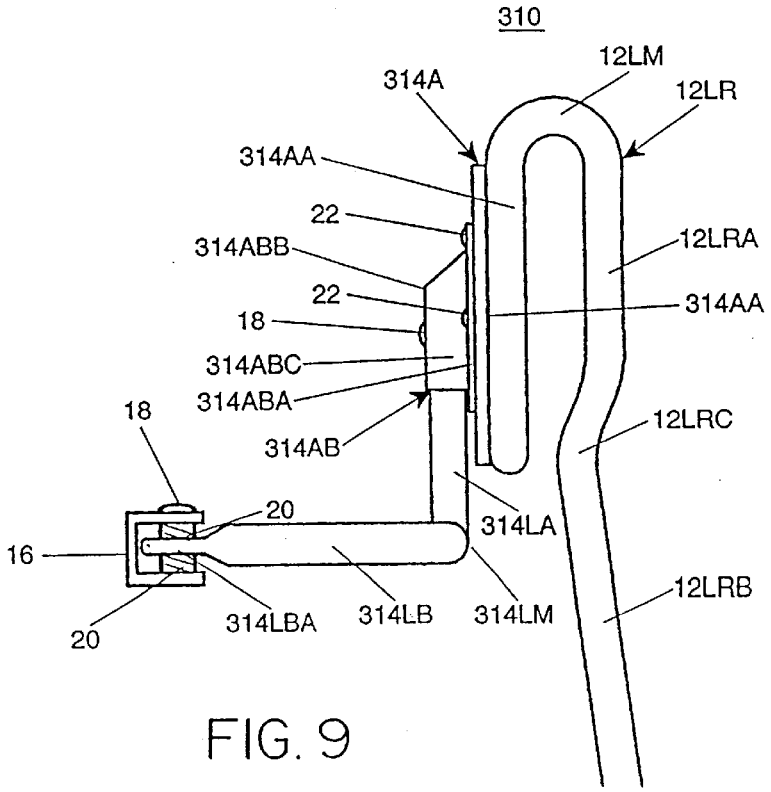

Now, referring to FIGS. 7 to 9 which are a left perspective view, front view, left side view, rear view, top view, and bottom view, respectively, of a third tool holder (310). The third tool holder (310) comprises a support (12) which comprises: a right rear support (12RR) having a right front support (12RF) securely connected to a right rear top support (12RRA) by a right middle support (12RF). The right rear top support (12RRA) is securely fastened to a right rear bottom support (12RRB) by a right rear transition support (12RRC). The right rear transition support (12RRC) is at an inward obtuse angle to the right rear top support (12RRA) and the right rear bottom support (12RRB). The right front support (12RF) is parallel to the the right rear top support (12RRA) and the right rear bottom support (12RRB).

A left rear support (12LR) which comprises a left front support (12LF) securely connected to a left rear top support (12LRA) by a left middle support (12LF). The left rear top support (12LRA) is securely fastened to a left rear bottom support (12LRB) by a left rear transition support (12LRC). The left rear transition support (12LRC) is at an inward obtuse angle to the left rear top support (12LRA) and the left rear bottom support (12LRB). The right rear transition support (12RRC) and the left rear transition support (12LRC) function to prevent inadvertant removal of the tool holder when a user withdraws a tool. The left front support (12LF) is parallel to the the left rear top support (12LRA) and the left rear bottom support (12LRB).

A support cross member (12A) is securely fastened at a lower distal end of the right rear bottom support (12RRB) and at a lower distal end of the left rear bottom support (12LRB). The left rear bottom support (12LRB) and the right rear bottom support (12RRB) function as a lever to prevent inadvertant removal of the tool holder from the user when a tool is withdrawn. The support cross member (12A) functions to connect the right rear support (12RR) to the left rear support (12LR). The third tool holder (310) is securely attached at a lower distal end of the right front support (12RF) and the left front support (12LF).

The third tool holder (310) comprises a third tool holder bracket cross member (314A) securely fastened to the the right front support (12RF) and the left front support (12LF). The third tool holder bracket cross member (314A) consists of a third tool holder bracket cross member rear plate (314AA) securely fastened to a third tool holder bracket cross member front plate rear (314ABA) of a third tool holder bracket cross member front plate (314AB). The third tool holder bracket cross member front plate (314AB) comprises a third tool holder bracket cross member front plate front (314ABB) securely connected to the third tool holder bracket cross member front plate rear (314ABA) by a third tool holder bracket cross member front plate transition (314ABC) forming a space bewteen the third tool holder bracket cross member front plate front (314ABB) and the third tool holder bracket cross member front plate rear (314ABA). The third tool holder bracket cross member front plate front (314ABB) has a pivot pin (18) securely mounted therein. A third tool holder bracket (314) is pivotally mounted on the pivot pin (18). The third tool holder bracket (314) comprises a third tool holder bracket right top member (314RA) connected to a third tool holder bracket left top member (314LA). The third tool holder bracket right top member (314RA) is securely connected to a third tool holder bracket right middle member (314RM) having a third tool holder bracket right inner transition member (314RCA) therebetween which is securely connected to a third tool holder bracket right bottom member (314RB) having a third tool holder bracket right outer transition member (314RCB) therebetween. The third tool holder bracket right bottom member (314RB) is securely connected to a third tool holder bracket right bottom front member (314RBA) which is pivotally mounted by a pivot pin (18) to a U-channel bracket (16) having a U-channel bracket pin opening (16A) therein through which the pivot pin (18) is inserted. A spring (20) is mounted around the pivot pin (18). The spring functions to return the U-channel bracket (16) to a perpendicular position to the hird tool holder bracket light bottom member (314RB). The third tool holder bracket left top member (314LA) is securely connected to a third tool holder bracket left middle member (314LM) having a third tool holder bracket left inner transition member (314LCA) therebetween which is securely connected to a third tool holder bracket left bottom member (314LB) having a third tool holder bracket left outer transition member (314LCB) therebetween. The third tool holder bracket left bottom member (314LB) is securely connected to a third tool holder bracket left bottom front member (314LBA) which is pivotally mounted by a pivot pin (18) to a U-channel bracket (16) having a U-channel bracket pin opening (16A) therein through which the pivot pin (18) is inserted. A spring (20) is mounted around the pivot pin (18). The spring functions to return the U-channel bracket (16) to a perpendicular position to the third tool holder bracket left bottom member (314LB).

The third tool holder (310) is manufactured from a material selected from a group consisting of metal, metal alloy, plastic, plastic composite, rubber, rubber composite, fiberglass, epoxy, and carbon-graphite.

Figure 10:
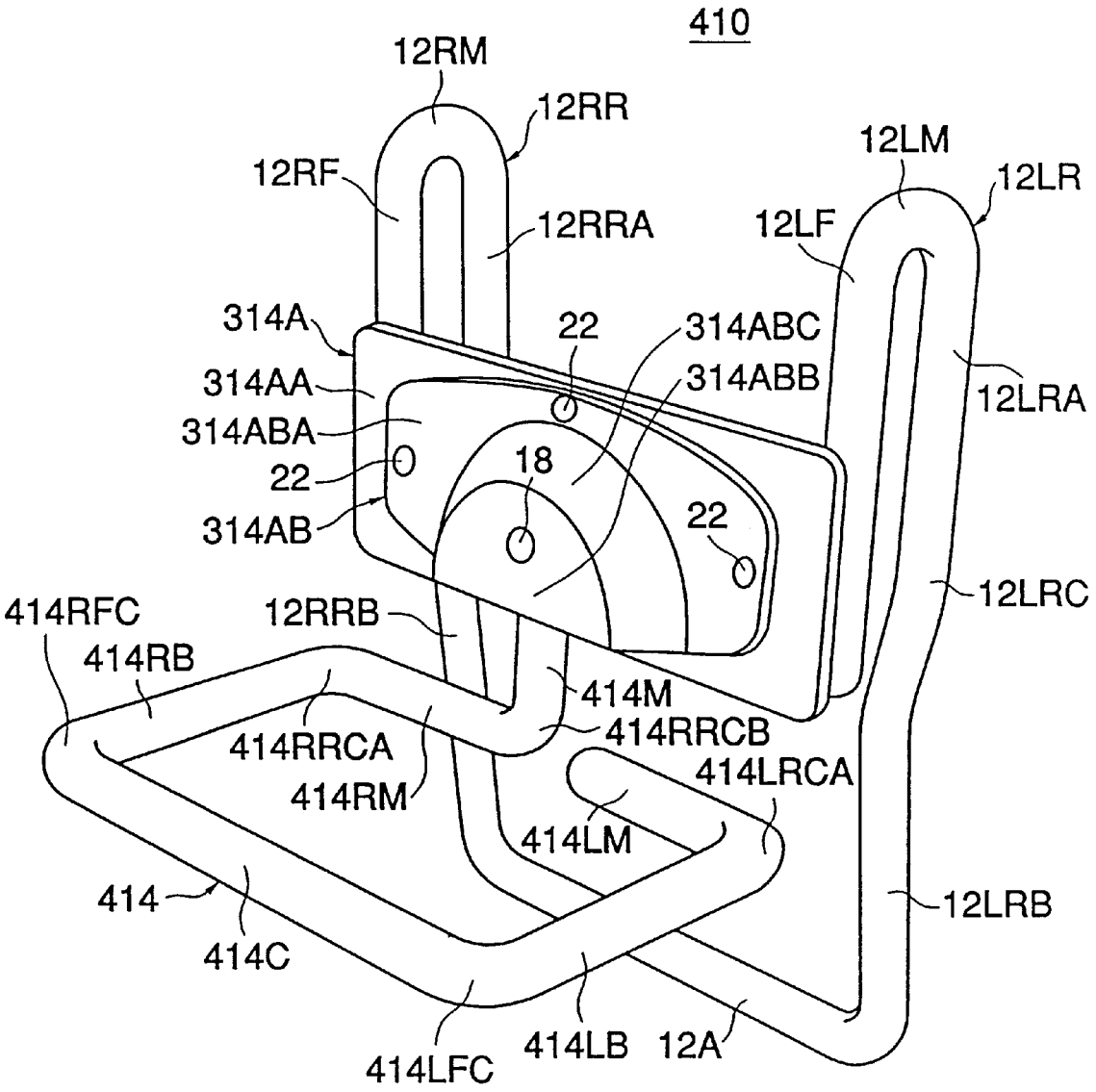
FIGS. 10–12 are perspective, front and side views of a fourth tool holder of the invention.
Figure 11:
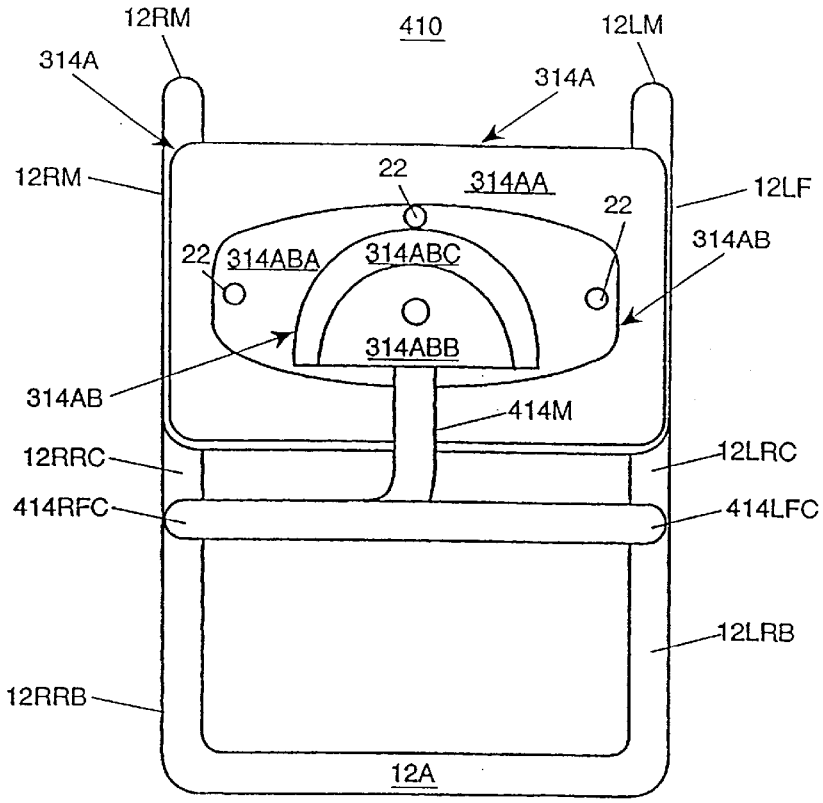
Figure 12:
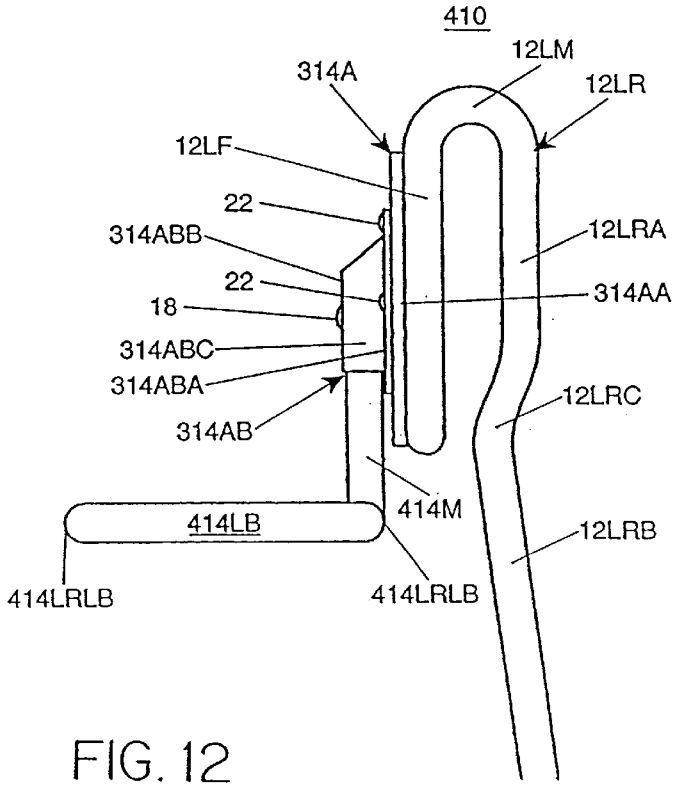

Lastly, referring to FIGS. 10 to 12 which are a left perspective view, front view, left side view, rear view, top view, and bottom view, respectively, of a fourth tool holder (410).The fourth tool holder (410) comprises a support (12) which comprises: a right rear support (12RR) having a right front support (12RF) securely connected to a right rear top support (12RRA) by a right middle support (12RF). The right rear top support (12RRA) is securely fastened to a right rear bottom support (12RRB) by a right rear transition support (12RRC). The right rear trnsition support (12RRC) is at an inward obtuse angle to the right rear top support (12RRA) and the right rear bottom support (12RRB). The right front support (12RF) is parallel to the the right rear top support (12RRA) and the right rear bottom support (12RRB).

A left rear support (12LR) which comprises a left front support (12LF) securely connected to a left rear top support (12LRA) by a left middle support (12LF). The left rear top support (12LRA) is securely fastened to a left rear bottom support (12LRB) by a left rear transition support (12LRC). The left rear transition support (12LRC) is at an inward obtuse angle to the left rear top support (12LRA) and the left rear bottom support (12LRB). The right rear transition support (12RRC) and the left rear transition support (12LRC) function to prevent inadvertant removal of the tool holder when a user withdraws a tool. The left front support (12LF) is parallel to the the left rear top support (12LRA) and the left rear bottom support (12LRB).

A support cross member (12A) is securely fastened at a lower distal end of the right rear bottom support (12RRB) and at a lower distal end of the left rear bottom support (12LRB). The left rear bottom support (12LRB) and the right rear bottom support (12RRB) funtion as a lever to prevent inadvertant removal of the tool holder from the user when a tool is withdrawn. The support cross member (12A) functions to connect the right rear support (12RR) to the left rear support (12LR). The fourth tool holder (410) is securely attached at a lower distal end of the right front support (12RF) and the left front support (12LF).

The fourth tool holder (410) comprises a fourth tool holder bracket (414) having a fourth tool holder bracket middle member (414M) which is pivotally mounted on the pivot pin (18) of the third tool holder bracket cross member (314A). The fourth tool holder bracket middle member (414M) is securely connnected to a fourth tool holder bracket right middle member (414RM) having a fourth tool holder bracket right rear inner transition member (414RRCB) therebetween. The fourth tool holder bracket right middle member (414RM) is securely connected to a fourth tool holder bracket right bottom member (414RB) having a fourth tool holder bracket right rear outer transition member (414RRCA) therebetween. The fourth tool holder bracket right bottom member (414RB) is securely connected to a fourth tool holder bracket cross member (414C) having a fourth tool holder bracket rightfront transition member (414RFC) therebetween. The fourth tool holder bracket cross member (414C) is securely connected to a fourth tool holder bracket left bottom member (414LB) having a fourth tool holder bracket left front transition member (414LFC) therebetween. The fourth tool holder bracket left bottom member (414LB) is securely connected to a fourth tool holder bracket left middle member (414LM) having a fourth tool holder bracket left rear outer transition member (414LRCA) therebetween.

The forth tool holder (410) is manufactured from a material selected from a group consisting of metal, metal alloy, plastic, plastic composite, rubber, rubber composite, fiberglass, epoxy, and carbon-graphite.

It will be understood that each of the elements described above, or two or more together, may also find a useful application in other types of constructions differing from the type described above.

While the invention has been illustrated and described as embodied in a tool holder, it is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

What is claimed is:

1. A tool holder for mounting on a user's belt comprising:

a support member having two front supports and two rear supports, each rear support having a rear top portion, a rear bottom portion, and a rear transition portion positioned therebetween, with each front support being spaced from and biased substantially parallel to the rear top portion and being nonparallel to the rear bottom portion, each rear transition portion extending toward the front support to provide a narrow gap which is smaller than the spacing between the front support and rear top portion, with the rear supports being connected by a support cross member, and the rear bottom portions extending away from the front supports; and a bracket member operatively associated with the front supports for holding a tool;

wherein, when the tool holder is mounted on a user'belt, the front supports and rear transition portions provide resistance to removal of the support member from the belt and the rear bottom portions are of substantially the same length as the rear top portions.

2. The tool holder of claim 1, wherein the bracket member includes a pair of side members, with each side member forming a lower end of a front support.

3. The tool holder of claim 2, which further comprises a center member connecting the side members of the bracket member, wherein the center member has an arcuate shape which projects above the side members.

4. The tool holder of claim 2, wherein each transition portion is positioned substantially adjacent to the lower end of the respective front support.

5. The tool holder of claim 2, wherein the bracket member includes opposing gate members pivotably mounted on the side members.

6. The tool holder of claim 1, which further comprises a bracket cross member connected between the front supports, the bracket member including a plurality of opposing gate members pivotably mounted thereon.

7. The tool holder of claim 6, wherein each gate member is pivotably mounted about a pivot pin and biased in opposing position by a spring.

8. The tool holder of claim 7, wherein each gate member is mounted on a side member which forms a lower end of a front support.

9. The tool holder of claim 8, wherein each gate member is mounted substantially perpendicular to the rear supports.

10. The tool holder of claim 1, which further comprises a bracket cross member connected between the front supports with the bracket member being joined to the bracket cross member by a pivotable connection.

11. The tool holder of claim 10, wherein the pivotable connection comprises a cover plate connected to the bracket cross member by a pivot pin.

12. The tool holder of claim 10, wherein the bracket member comprises a wire bent to form a substantially rectangular shape.

13. The tool holder of claim 12, wherein the bent wire is mounted substantially perpendicular to the rear supports.

* * * * *